US006386879B1

(12) United States Patent
Varshneya et al.

(10) Patent No.: US 6,386,879 B1
(45) Date of Patent: May 14, 2002

(54) PRECISION GUNNERY SIMULATOR SYSTEM AND METHOD

(75) Inventors: Deepak Varshneya, Del Mar; Wallace Sterling Perkes, Poway, both of CA (US)

(73) Assignee: Cubic Defense Systems, Inc., San Diego, CA (US)

( * ) Notice: Subject to any disclaimer, the term of this patent is extended or adjusted under 35 U.S.C. 154(b) by 0 days.

(21) Appl. No.: 09/534,773

(22) Filed: Mar. 24, 2000

(51) Int. Cl.[7] ..... F41G 3/26
(52) U.S. Cl. ..... 434/16; 434/27; 463/12
(58) Field of Search ..... 434/11–16, 7; 463/2, 49–57

(56) References Cited

U.S. PATENT DOCUMENTS

| | | | | | |
|---|---|---|---|---|---|
| 3,588,108 | A | | 6/1971 | Ormiston et al. | 273/101.1 |
| 3,609,883 | A | | 10/1971 | Erhard | 35/25 |
| 3,832,791 | A | | 9/1974 | Robertsson | 35/25 |
| 4,577,962 | A | * | 3/1986 | de Guillenschmidt et al. | 356/5.05 |
| 4,737,106 | A | | 4/1988 | Laciny | 434/22 |
| 4,789,339 | A | | 12/1988 | Bagnall-Wild et al. | 434/20 |
| 5,215,462 | A | * | 6/1993 | Lewis et al. | 434/19 |
| 5,228,854 | A | * | 7/1993 | Eldridge | 434/11 |
| 5,256,066 | A | * | 10/1993 | LaRussa | 434/21 |
| 5,378,155 | A | * | 1/1995 | Eldridge | 434/11 |
| 5,382,958 | A | * | 1/1995 | FitzGerald | 342/386 |
| 5,788,500 | A | * | 8/1998 | Gerber | 434/22 |
| 6,254,394 | B1 | * | 7/2001 | Draper et al. | 434/11 |

FOREIGN PATENT DOCUMENTS

| | | |
|---|---|---|
| WO | WO 00/08405 | 2/2000 |

* cited by examiner

*Primary Examiner*—Joe H. Cheng
*Assistant Examiner*—Kathleen M Christman
(74) *Attorney, Agent, or Firm*—Michael H. Jester

(57) ABSTRACT

A turret mounted gun on a shooter tank with a laser scanner transmitter in its barrel emits a laser beam upon a trigger pull. The laser beam is directed toward a target tank based upon a shooter's ranging and tracking using a standard fire control computer to provide conventional ranging and tracking. The target tank is scanned with the laser beam to measure target azimuth and target elevation with respect to a boresight of the gun of shooter tank. Optical receivers mounted on the turret of the target tank detect the laser beam and a system control unit determines the trigger pull time, target azimuth and target super elevation. The system control unit also determines a range to the target tank by comparing a set of GPS coordinates of the two tanks. Based on the target azimuth, the target super elevation, the range to the target and the time of the trigger pull, the system control unit computes an impact point relative to the target tank of a simulated ballistic shell fired from the gun of the first tank at the time of the trigger pull. Casualty assessment is made and the impact point is transmitted back to the shooter for immediate feedback.

24 Claims, 3 Drawing Sheets

PRECISION GUNNERY SIMULATOR SYSTEM AND METHOD

BACKGROUND OF THE INVENTION

The present invention relates to military training systems and methods, and more particularly, to a system and method particularly adapted for simulating tank fire in simulated war games.

Combustion powered artillery has long been classified according to the path or trajectory of its projectile. A motor lobs its shell in a high parabolic path. The shell fired from a gun, such as a tank gun, has a direct somewhat level and slightly downwardly curved path. The shell from a howitzer makes a useful compromise, traveling over an arcuate path of considerable distance requiring less propulsive explosive and a lighter barrel than that of a gun.

The United States Military has developed and extensively used the Multiple Integrated Laser Engagement System (MILES) for turning ground forces in military operations. Rifles are fitted with low power lasers and simulated kills are made by hitting a soldier wearing a vest carrying optical detectors. In more elaborate inplementations, indirect fire from mortars and howitzers can be simulated, as well as mine fields, in some cases by using player units equipped with Global Positioning System (GPS) locators. Pyrotechnics and sound have been added to provide enhanced realism.

Tanks are still a very important component of ground assault operations. Any laser based system for simulating gun fire from a tank must take into account the fact that a real projectile, such as a one hundred and twenty millimeter shell, follows a curved trajectory and takes a substantial amount of time to move from the tank to the target or target area. In contrast, a laser beam moves in a straight line at the speed of light. Numerous gunnery training systems have been developed such as those disclosed in U.S. Pat. Nos. 3,588,108; 3,609,883; and 3,832,791. U.S. Pat. No. 4,218,834 of Robertson entitled, SCORING OF SIMULATED WEAPONS FIRE WITH SWEEPING FAN-SHAPED BEAMS discloses a gunnery training system designed to more accurately simulate tank fire in complex tactical situations than the systems of the three U.S. patents mentioned earlier. Flat-wise angularly sweeping beams of laser radiation are emitted at or about the instant of simulated canon fire. These same beams are also used to measure the position of a target retro-reflector in range in terms of azimuth and elevation. During this same time period a calculation is made of the instantaneous position in terms of range, azimuth and elevation of a simulated projectile. The relationship is calculated between the simulated projectile and each beam in its angular position at interception by the retro-reflector. At the scoring instant when the weapon-to-reflector distance equals the weapon-to-projectile distance, or when the projectile is at a predetermined elevation relative to the reflector, scoring is based on the relationship of the projectile to the angular beam position at the aforementioned instant. Scoring results are displayed in the tank and/or transmitted to the target in beam modulation for evaluation of hit effect at the target.

While the system and method of the aforementioned Robertson patent has been commercialized with some degree of success, it would be desirable to provide a more precise gunnery training system that takes advantage of GPS locators and has improved capabilities and flexibilities to further enhance the realism of the tank gunnery training exercise in complex tactical situations.

SUMMARY OF THE INVENTION

In accordance with the present invention a gunnery simulation system includes a gun with an emitter in its barrel that emits a beam of optical radiation at a first location upon a trigger pull. The beam is directed toward a target at a second location based upon a shooter's conventional ranging and tracking. The target is scanned with the beam of radiation to measure a target azimuth and a target elevation with respect to a boresight of the gun. A time of the trigger pull is transmitted to the second location. Optical receivers at the second location detect the beam of optical radiation and a system control unit determines the target azimuth and target elevation. The system control unit also determines a range to the target by comparing a set of GPS coordinates of the gun and the target. Based on the target aznimuth, the target elevation, the range to the target and the time of the trigger pull the system control unit computes an impact point relative to the target of a simulated ballistic shell fired from the gun at the time of the trigger pull.

DETAILED DESCRIPTION OF THE PREFERRED EMBODIMENTS

Figures 1A, 1B:
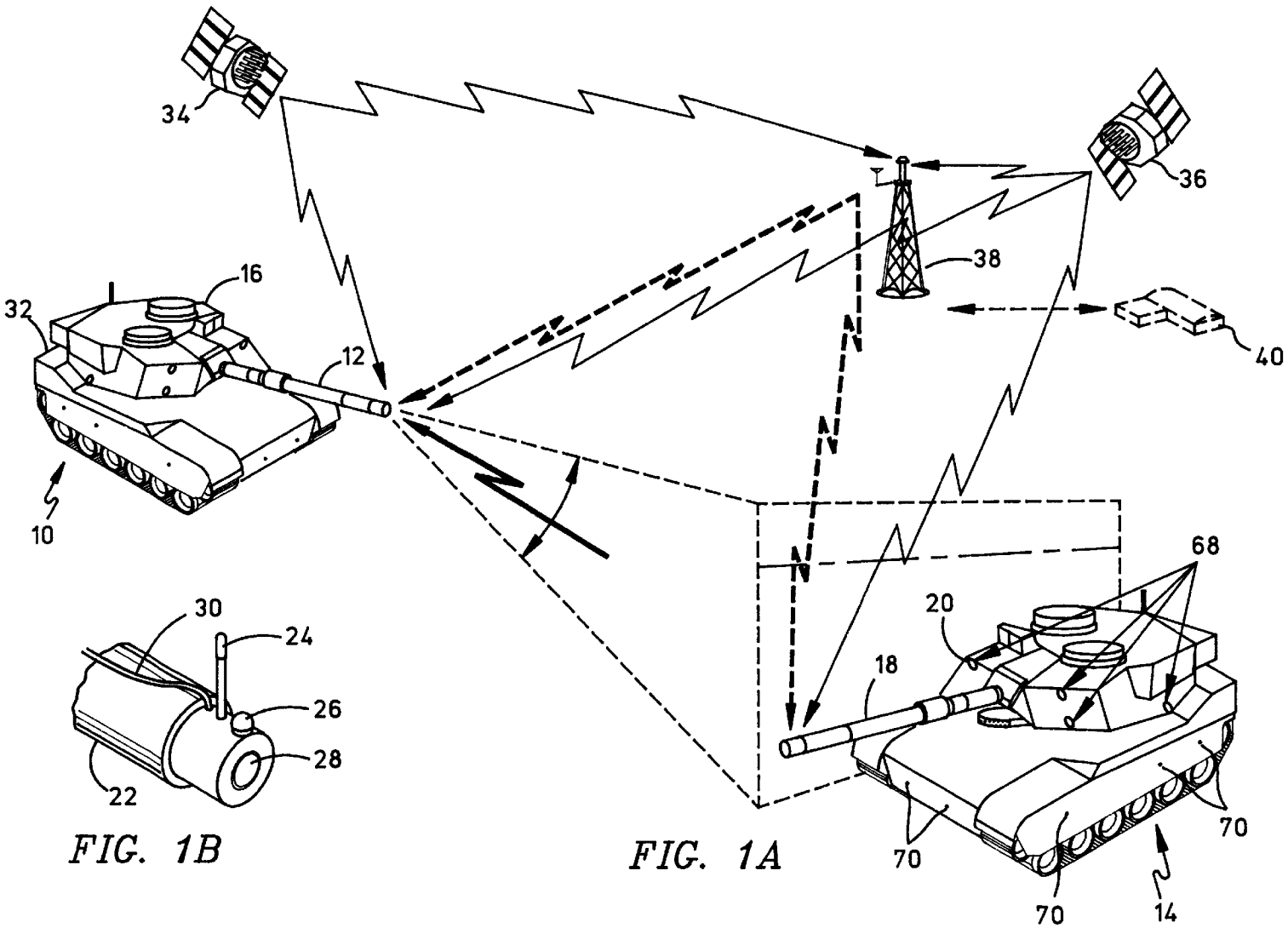
FIG. 1A is a diagrammatic illustration of two tanks in a simulated engagement utilizing the system and method of the present invention.
FIG. 1B is an enlarged fragmentary view of the gun muzzle of one of the tanks illustrated in FIG. 1A showing the antennas and laser scanner transmitter mounted to the muzzle.

The overall architecture of a preferred embodiment of our precision gunnery simulator system is illustrated in FIG. 1A. A first friendly tank or shooter 10 is shown engaging and firing its gun 12 upon a second enemy tank 14. The friendly tank 10 is at a first location and the enemy tank 14 is at a second location which would typically be several hundred meters from the first location. It will be understood that one or both of the tanks 10 and 14 could be stationary or moving at speeds of up to sixty kilometers per hour and more. The gun 12 of the first tank 10 is mounted on a stabilized turret 16 in conventional fashion. Similarly, the gun 18 of the second tank 14 is also mounted on a stabilized turret 20. By way of example, the tanks 10 and 14 may be M1A1 tanks with one hundred and twenty milimeter guns with a normal firing range of 3,500 meters (SABOT) and 2,500 meters (HEAT).

Referring still to FIG. 1B, each of the tanks 10 and 14 has mounted on its gun muzzle 22 a data link antenna 24 and a GPS antenna 26. Each of the tanks 10 and 14 also has a laser scanner transmitter 28 mounted in the bore of the gun muzzle 22. A cable 30 operatively connects the data link antenna 24, GPS antenna 26 and laser scanner transmitter 28 to system electronics carried inside the turret 16 or hull 32 of the associated tank. The GPS antenna 26 mounted on the gun muzzle 22 of each tank receives downlink geographic locating signals from twelve different Earth orbiting GPS satellites 34 and 36, only two of which are shown in FIG. 1A. Optionally more precise geographic locating signals in the form of DGPS correction signals are transmitted to the GPS antenna 26 of each of the tanks 10 and 14 by a ground based GPS reference station 38. The GPS reference station 38 receives downlink locating signals from the satellites 34 and 36. Optionally the GPS reference station can also relay radio frequency (RF) data between the tanks 10 and 14 and a command station 40 for the purpose of providing reports, monitoring engagements or controlling the precision gunnery simulator system in some way, such as providing mission protocols. In FIG. 1A the thin solid zig-zag lines illustrate the transmission of GPS signals, the dashed zig-zag lines illustrate the transmission of DGPS correction signals, and the thick solid zig zag line going into the muzzle 22 of the gun 12 of the shooter tank 10 illustrates the RF response to the interrogator.

Preferably the antennas 24 and 26, the laser scanner transmitter 28 and the cable 30 can be readily installed and removed without interfering with the normal firing of live rounds so that the tanks 10 and 14 will always be ready for real battle. The laser scanner transmitter 28 emits a beam of optical wavelength radiation that is used both to scan the position of the opposing tank, to act as a simulated ballistic round fired from the gun in which it is mounted, and as a data link for transmitting information to the opposing tank to allow the impact of the simulated round to be computed.

Figure 2:
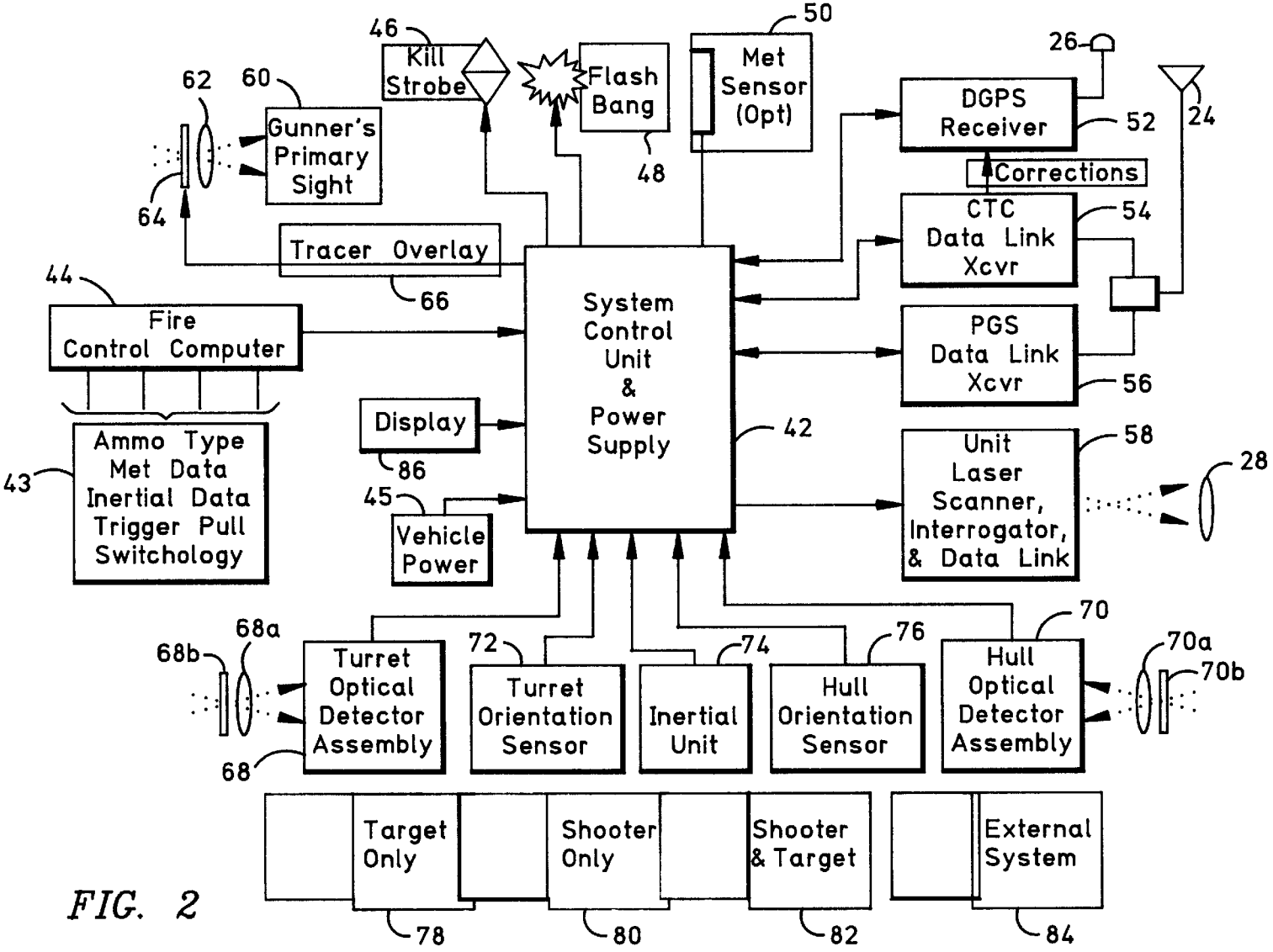
FIG. 2 is a block diagram of a preferred embodiment of the electronics mounted in each tank in accordance with the system of the present invention.

FIG. 2 is a block diagram of a preferred embodiment of the electronics preferably mounted in the crew compartment of each tank 10 and 14 in accordance with the system of the present invention. A system control unit 42 forms the core of the electronics. The control unit 42 has its own power supply and is preferably microprocessor based. It includes ample memory for storing a firmware operational program. Preferably the system control unit 42 has a keyboard or other input device 43 connected thereto via a fire control computer (FCC) 44 for purposes of crew input commands. The input device 43 allows ammo type, Met data, inertial data, and so forth to be entered by the crew. The input device 43 preferably has a trigger switch that may be pulled by the crew to fire a simulated round. The input device 43 and FCC 44 may be provided by the existing hardware in the tank or may be parallel devices that simulate those real counterparts of the tank. A removable media storage device (not illustrated) is preferably connected to the system control unit 42 in order to facilitate the loading of changes in the operational program. The power supply of the control unit 42 derives its power from the vehicle power supply 45.

Referring still to FIG. 2, a kill strobe 46 and a flash bang generator 48 can be activated by the system control unit 42. Audio speakers and audio amplifiers (not shown) as well as smoke generators (not shown) may also be connected to the system control unit 42 to further enhance the realism of the simulated tank battle. An optional Met sensor 50 may be connected to the system control unit 42. The GPS antenna 26 is connected to the system control unit 42 through a DGPS receiver 52. The data link antenna 24 is connected to the system control unit 42 via a CTC data link transceiver unit 54 and a PGS data link transceiver unit 56. The DGPS correction signals from the GPS reference station 38 are received via the data link antenna 24 are fed through the CTC data link transceiver unit 54 to the DGPS receiver 52. The laser scanner transmitter 28 is driven by a laser scanner, interrogator and data link circuit 58 controlled by the system control unit 42.

The gunner's primary sight 60 (FIG. 2) has a lens assembly 62 and tracer overlay 64 that communicates with the system control unit 42 via tracer overlay drive circuit 66. A first array 68 of optical sensors is spaced around the tank turret 16. A second array 70 of optical sensors is spaced around the tank hull 32. The arrays 68 and 70 may include lenses and protective covers 68a, 68b and 70*a,* 70*b,* respectively. Each of the arrays is made of individual laser detectors that generate signals and transmit them to the system control unit when struck by the laser beam from the laser scanner transmitter 28 of an opposing tank. As shown in FIG. 1, the detectors of the arrays 68 and 70 are spaced about the turret and hull so that they can detect a laser scan or simulated laser projectile from all angles likely to be encountered. A turret orientation sensor 72 (such as an optical encoder), inertial unit 74 and hull orientation sensor 76 all feed data signal the system control unit 42. A target only module 78, a shooter only module 80, a shooter and target module 82 and an external system module 84 may optionally be connected to the system control unit 42.

Before trigger pull the shooter performs ranging and tracking functions. This is achieved by optically scanning the target tank 14. The field of view (FOV) of the shooter is large enough to include all types of ammo that can be fired by the tank 10. The laser scanner transmitter 28 of the shooter tank 10 periodically transmits optical data to the target tank 14 during a scan. The target tankl4 decodes the optical data, encodes its DGPS position, its ID, the shooter ID, the optical azimuth and elevation and broadcasts an RF message to the shooter tank 10. The RF message is processed by the shooter tank 10 so long as its ID matches with the returned message, it being understood that our system allows more than two tanks to engage each other simultaneously. Target aiming and tracking are then carried out in the conventional fashion by the FCC 44 and this generates the required gun lead.

At trigger pull the shooter/target geometry is determined by a combination of direct optical measurements via the shooter laser scanner transmitter 28, DGPS and optical/RF data links. At trigger pull (TP),the laser scanner transmitter 28 is used to measure the target azimuth (AZ) and super elevation (EL) with respect to the shooter's boresight. Scan duration is much faster than the shot fly-out time (fast enough to prevent overall accuracy degradation). Further details of scanning techniques are disclosed in U.S. Pat. No. 4,218,834 of Hans R. Robertson granted Aug. 26, 1980, the entire disclosure of which is hereby incorporated by reference. The shooter laser scanner transmitter 28 transmits full shooter data in on-target beam dwell time including the TP time, shooter ID, weapon type, ammo type, gun tilt and twist angles, GPS (x,y,z) data, GPS (Vx, Vy, Vz) data, Met data (optional), etc. The data that is optically transmitted is decoded by the electronics in the target tank 14 which are the same as those in the shooter tank 10 and illustrated in FIG. 2. The target tank 14 determines the target AZ and target super EL with resect to the shooter's boresight, either by 1) knowing the trigger pull time and scan rate or 2) decoding the transmitted scan angular position data. Range to the target is determined by comparing the shooter and target GPS coordinates. The orientation of the entire shooter/target geometry with respect to gravity is determined from the DGPS or tilt and twist sensors 72, 74 and 76.

The system control unit 42 of the target tank 14 runs a ballistic simulation using the data transmitted optically from the shooter tank 10. It derives the AZ and super EL from the boresight via scan timing or data. The target tank 14 tracks its own motion during fly-out via DGPS and carrier phase. From all of this information, the system control unit 42 of the target tank 14 determines the impact point of the imaginary projectile. If a miss is determined, the weapon/target perigee is determined instead. The crew of the target tank 14 is informed of the results of the enemy fire preferably by intercom and collateral damage is simulated. If a hit is determined, the shot aspect angle is calculated from the detectors and turret encoder data. The system control unit 42 then performs a casualty assessment in accordance with the impact coordinates, range, shot aspect angle, known weapon/target vulnerability data and so forth. The system control unit 42 then notifies the shooter tank 10 via the kill strobe 46 and the RF data link. Pk, range and hit coordinates are displayed on a display 86 (FIG. 2) in the shooter tank's crew cabin.

A simplified weapon fly-out simulation is also performed by the system control unit 42 of the shooter tank 10. This permits a weapon fly-out tracer display to the shooter via an overlay on the gunner's sight. Compensation is made for the motion of the shooter tank 10 during weapon fly-out. Sufficient data is recorded via a camera (not shown) to support a diagnostic after action review (AAR).

Figure 3:
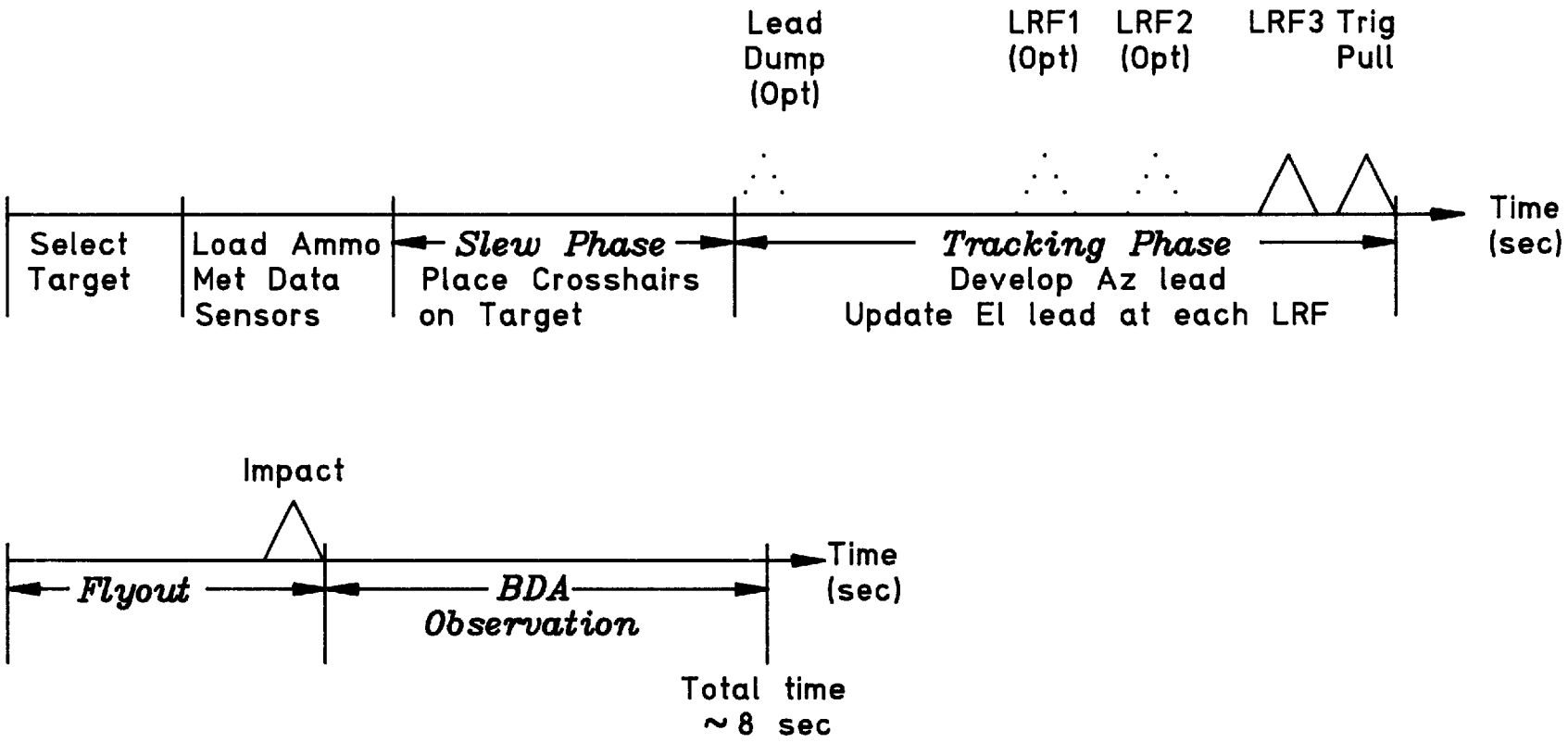
FIG. 3 is a timing diagram illustrating the sequence of steps of the method of the present invention.

FIG. 3 is a self-explanatory timing diagram illustrating the sequence of steps of the method of the present invention.

In our system, no retro-reflectors are required for measuring target range, AZ and EL with a respect to boresight. No high precision inertial measurement unit is required in order to predict the fall of the shot, i.e. for correcting projectile trajectory. In our system, the ballistic simulation is run at the target tank 14 and DGPS is used for target tracking. The use of an RF data link and GPS leads to much lower cost than prior art gunnery simulator systems. Our system can be used in either in fire and forget or tracking modes. Its hit/miss accuracy is improved over that of prior gunnery simulation systems because of a faster scan rate and because DGPS tracking of the target tank 14 is independent of shot fly-out time. Our system can be used to train in normal, degraded, manual and emergency modes. The user follows the same operational steps involved in firing on a tank with a live round in a combat situation. Our system and method accommodate multiple shooters and multiple targets. The range to target generates gun super EL offset. The target is tracked to generate gun lead offset. Our system is capable of determining the impact point (or miss perigee) with respect to the center of mass of the target tank. A weapon fly-out tracer is displayed to the shooter and provides immediate feedback. Realistic Pk and casualty assessment are performed. Our system and method disseminate engagement results in near real time. Engagement exercises can be recorded to support diagnostic AAR. Shooters and targets are unambiguously paired.

While we have described preferred embodiments of our system and method, it should be understood that our invention can be modified in both arrangement and detail. Therefore, the protection afforded our invention should only be limited in accordance with the scope of the following claims.

We claim:

1. A gunnery simulation system, comprising:

means for emitting a beam of optical radiation from a gun at a first location upon a trigger pull toward a target at a second location based upon a shooter's conventional ranging and tracking;

means for scanning the target with the beam of radiation to measure a target azimuth and a target elevation with respect to a boresight of the gun;

means for transmitting a time of the trigger pull;

means for detecting at the target the beam of optical radiation to determine the target azimuth and target elevation;

means for determining a range to the target by comparing a set of GPS coordinates of the gun and the target; and means for computing an impact point relative to the target of a simulated ballistic shell fired from the gun at the time of the trigger pull based on the target azimuth, the target elevation, the range to the target and the time of the trigger pull.

2. The system of claim 1 wherein the target azimuth and the target elevation with respect to the boresight of the gun are determined based upon the time of the trigger pull and a rate of scan.

3. The system of claim 1 wherein the target azimuth and the target elevation with respect to the boresight of the gun are determined based upon scan angular position data transmitted from the first location.

4. The system of claim 1 wherein the gun and target are both moving and the step of computing the impact point is also based upon the output of tilt and twist sensors mounted on the gun and the target.

5. The system of claim 1 and further comprising means for transmitting from the first location to the second location a signal encoded on the beam of optical radiation including GPS (x, y, z) data.

6. The system of claim 1 wherein the gun is mounted on a tank and the beam of optical radiation is emitted from a laser scanner transmitter fitted in a barrel of the gun.

7. The system of claim 1 wherein the target is a tank equipped with a plurality of optical receivers mounted on a hull of the tank.

8. The system of claim 1 wherein the target is a tank equipped with a plurality of optical receivers mounted on a turret of the tank.

9. A gunnery simulation method, comprising the steps of:

emitting a beam of optical radiation from a gun at a first location upon a trigger pull toward a target at a second location based upon a shooter's conventional ranging and tracking;

scanning the target with the beam of radiation to measure a target azimuth and a target elevation with respect to a boresight of the gun;

transmitting a time of the trigger pull;

detecting at the target the beam of optical radiation to determine the target azimuth and target elevation;

determining a range to the target by comparing a set of GPS coordinates of the gun and the target; and computing an impact point relative to the target of a simulated ballistic shell fired from the gun at the time of the trigger pull based on the target azimuth, the target elevation, the range to the target and the time of the trigger pull.

10. The method of claim 9 wherein the target azimuth and the target elevation with respect to the boresight of the gun are determined based upon the time of the trigger pull and a rate of scan.

11. The method of claim 9 wherein the target azimuth and the target elevation with respect to the boresight of the gun are determined based upon scan angular position data transmitted from the first location.

12. The method of claim 9 wherein the gun and target are both moving and the step of computing the impact point is also based upon the output of tilt and twist sensors mounted on the gun and the target.

13. The method of claim 9 and further comprising the step of transmitting from the first location to the second location a signal encoded on the beam of optical radiation including GPS (x, y, z) data.

14. The method of claim 9 wherein the gun is mounted on a tank and the beam of optical radiation is emitted from a laser scanner transmitter fitted in a barrel of the gun.

15. The method of claim 9 wherein the target is a tank equipped with a plurality of optical receivers mounted on its hull.

16. The method of claim 9 and further comprising the step of displaying at the first location the computed impact point of the simulated ballistic shell.

17. A method of simulating an exchange of fire between a shooter tank and a target tank, comprising the steps of:

from a shooter tank, scanning a target tank with a laser beam to determine an azimuth and elevation to the target tank relative to a boresight of the shooter tank;

using conventional ranging and tracking and a standard file control of the target tank to execute, upon a trigger pull, the firing of a simulated projectile at the target tank;

determining, at the target tank, the azimuth and elevation to the target tank relative to the boresight of the shooter tank at a time of the trigger pull; and computing an impact point of the simulated projectile at least based upon the determined azimuth and elevation, the time of the trigger pull and the motion of the target tank since the time of the trigger pull.

18. The method of claim 17 and further comprising the step of transmitting, via the laser beam, from the shooter tank to the target tank, data representative of a position and a speed of the shooter tank at the time of the trigger pull and using the data to compute the impact point.

19. The method of claim 17 and further comprising the step of transmitting, via the laser beam, from the shooter tank to the target tank data representative of the time of the trigger pull.

20. The method of claim 17 and further comprising the step of transmitting, via the laser beam, from the shooter tank to the target tank, data representative of a twist and a tilt of a gun of the shooter tank at the time of the trigger pull and using the data to compute the impact point.

21. The method of claim 17 and further comprising the step of transmitting, via the laser beam, from the shooter tank to the target tank, data representative of a type of simulated projectile fired by the shooter tank and using the data to compute the impact point.

22. The method of claim 17 wherein the computation of the impact point is based in part upon a first set of GPS coordinates of the shooter tank and a second set of GPS coordinates of the target tank.

23. The method of claim 17 and further comprising the step of communicating the computed impact point from the target tank to the shooter tank.

24. The method of claim 17 and further comprising the step of decoding a message at the shooter tank sent via the laser beam and transmitting an RF signal back to the shooter tank for decoding at the shooter tank based upon a determined identity match.

* * * * *